US006648192B1

(12) United States Patent
Chong

(10) Patent No.: US 6,648,192 B1
(45) Date of Patent: Nov. 18, 2003

(54) COOKING UTENSIL RETAINING APPARATUS

(76) Inventor: Alvin H. Chong, 2841 E. 24th Ave., Vancouver BC (CA), V5R 1E5

( * ) Notice: Subject to any disclaimer, the term of this patent is extended or adjusted under 35 U.S.C. 154(b) by 126 days.

(21) Appl. No.: 09/939,030

(22) Filed: Aug. 24, 2001

(51) Int. Cl.[7] ..... A45F 5/00
(52) U.S. Cl. ..... 224/268; 224/904
(58) Field of Search ..... 224/268, 269, 224/666, 904

(56) References Cited

U.S. PATENT DOCUMENTS

| | | | | | |
|---|---|---|---|---|---|
| 334,101 | A | * | 1/1886 | Buffum | 224/269 |
| 636,295 | A | * | 11/1899 | Sibthorpe | 224/268 |
| 1,270,158 | A | * | 6/1918 | Hill | 224/666 |
| 2,775,804 | A | | 1/1957 | Ayoub | |
| 3,200,536 | A | * | 8/1965 | Petitto, Sr. | 446/28 |
| 3,963,156 | A | * | 6/1976 | Perrin | 224/268 |
| D275,527 | S | * | 9/1984 | Gee | D3/215 |
| 4,974,764 | A | * | 12/1990 | Cantwell | 224/269 |
| 5,025,587 | A | * | 6/1991 | Creed | 43/55 |
| 5,119,979 | A | | 6/1992 | Kallman | |
| 5,619,774 | A | | 4/1997 | Perry | |
| 5,839,167 | A | | 11/1998 | Wagner | |
| D403,296 | S | | 12/1998 | Thomas | |
| 5,946,733 | A | * | 9/1999 | Spooner | 2/312 |
| 5,964,386 | A | | 10/1999 | Cote | |
| 6,062,449 | A | * | 5/2000 | Kahn | 224/268 |

* cited by examiner

*Primary Examiner*—Stephen K. Cronin

(57) ABSTRACT

A cooking utensil retaining apparatus for carrying cooking utensils while working. The cooking utensil retaining apparatus includes a flat elongate member with a plurality of bends designed to be releasably attachable to a user and accessibly holding certain cooking utensils while working.

4 Claims, 2 Drawing Sheets

FIG. 2
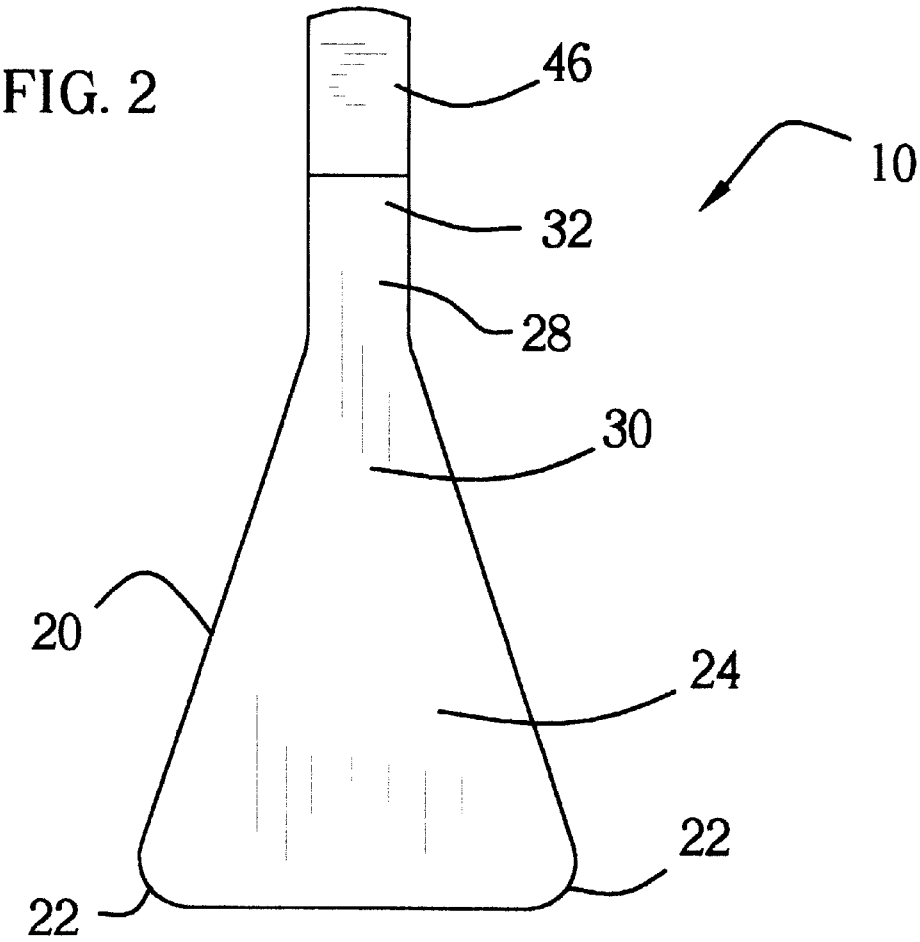
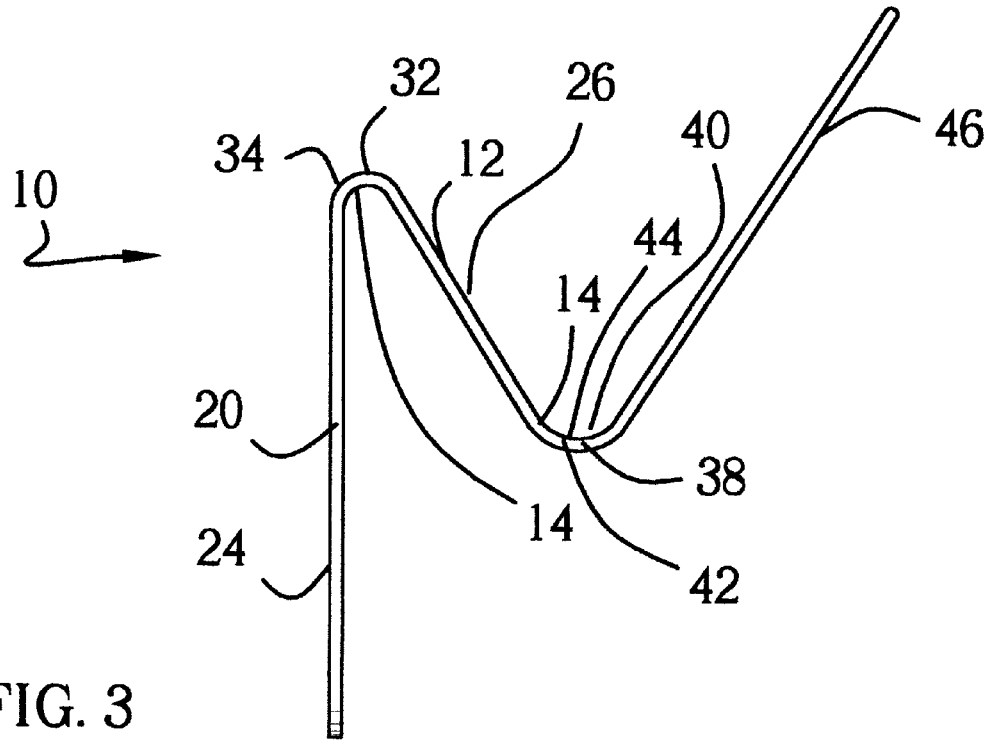
FIG. 3

COOKING UTENSIL RETAINING APPARATUS

BACKGROUND OF THE INVENTION

1. Field of the Invention

The present invention relates to utensil holders and more particularly pertains to a new cooking utensil retaining apparatus for carrying cooking utensils while working.

2. Description of the Prior Art

The use of utensil holders is known in the prior art. More specifically, utensil holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,119,979; U.S. Pat. No. 5,619,774; U.S. Pat. No. 2,775,804; U.S. Pat. No. 5,839,167; U.S. Pat. No. 5,964,386; and U.S. Pat. No. Des. 403,296.

While these devices fulfill their respective, particular objectives and requirements, the aforementioned patents do not disclose a new cooking utensil retaining apparatus. The inventive device includes a flat elongate member with a plurality of bends designed to be releasably attachable to a user and accessibly holding certain cooking utensils while working.

In these respects, the cooking utensil retaining apparatus according to the present invention substantially departs from the conventional concepts and designs of the prior art, and in so doing provides an apparatus primarily developed for the purpose of carrying cooking utensils while working.

SUMMARY OF THE INVENTION

In view of the foregoing disadvantages inherent in the known types of utensil holders now present in the prior art, the present invention provides a new cooking utensil retaining apparatus construction wherein the same can be utilized for carrying cooking utensils while working.

The general purpose of the present invention, which will be described subsequently in greater detail, is to provide a new cooking utensil retaining apparatus apparatus and method which has many of the advantages of the utensil holders mentioned heretofore and many novel features that result in a new cooking utensil retaining apparatus which is not anticipated, rendered obvious, suggested, or even implied by any of the prior art utensil holders, either alone or in any combination thereof.

To attain this, the present invention generally comprises a flat elongate member with a plurality of bends designed to be releasably attachable to a user and accessibly holding certain cooking utensils while working.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cooking utensil retaining apparatus apparatus and method which has many of the advantages of the utensil holders mentioned heretofore and many novel features that result in a new cooking utensil retaining apparatus which is not anticipated, rendered obvious, suggested, or even implied by any of the prior art utensil holders, either alone or in any combination thereof.

It is another object of the present invention to provide a new cooking utensil retaining apparatus, which may be easily and efficiently manufactured and marketed.

It is a further object of the present invention to provide a new cooking utensil retaining apparatus, which is of a durable and reliable construction.

An even further object of the present invention is to provide a new cooking utensil retaining apparatus which is susceptible of a low cost of manufacture with regard to both materials and labor, and which accordingly is then susceptible of low prices of sale to the consuming public, thereby making such cooking utensil retaining apparatus economically available to the buying public.

Still yet another object of the present invention is to provide a new cooking utensil retaining apparatus, which provides in the apparatuses and methods of the prior art some of the advantages thereof, while simultaneously overcoming some of the disadvantages normally associated therewith.

Still another object of the present invention is to provide a new cooking utensil retaining apparatus for carrying cooking utensils while working.

Yet another object of the present invention is to provide a new cooking utensil retaining apparatus which includes a flat elongate member with a plurality of bends designed to be releasably attachable to a user and accessibly holding certain cooking utensils while working.

Still yet another object of the present invention is to provide a new cooking utensil retaining apparatus that keeps often used cooking utensils such as a cook's pair of tongs readily available.

Even still another object of the present invention is to provide a new cooking utensil retaining apparatus that helps improve the sanitary condition of the cooking utensil by keeping it from being randomly laid down in unsanitary areas between uses.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a back view of the present invention.

FIG. 3 is a side view of the present invention.

DESCRIPTION OF THE PREFERRED EMBODIMENT

Figure 1:
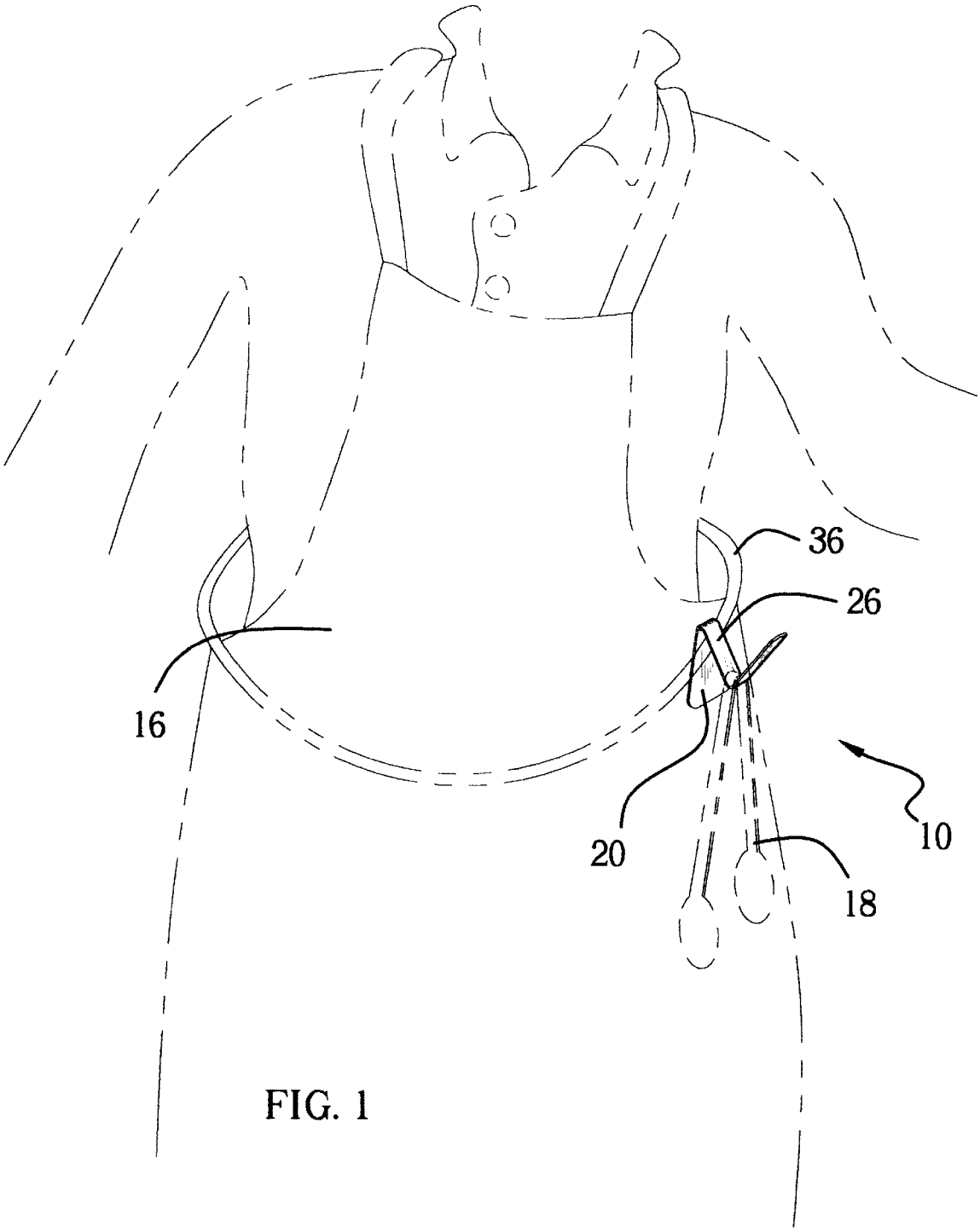
FIG. 1 is a perspective view of a new cooking utensil retaining apparatus attached to a user according to the present invention.

With reference now to the drawings, and in particular to FIGS. 1 through 3 thereof, a new cooking utensil retaining apparatus embodying the principles and concepts of the present invention and generally designated by the reference numeral 10 will be described.

As best illustrated in FIGS. 1 through 3, the cooking utensil retaining apparatus 10 generally comprises a flat elongate member12. The flat elongate member12 has a plurality of bends 14. The plurality of bends 14 are designed for forming the flat elongate member12 in such a manner that the flat elongate member12 is releasably attachable to a user 16 for the purpose of carrying cooking utensils such as a pair of cooking tongs 18 while working.

The flat elongate member12 has a plate member 20. The plate member 20 is approximately triangular in shape. The plate member 20 has substantially rounded corners 22. The plate member 20 is designed for resting against the body of the user 16 such that an inner surface 24 of the flat elongate member12 contacts the body of the user 16 thereby supporting the flat elongate member12 in a transverse manner with respect to a longitudinal axis of the flat elongate member12.

The flat elongate member12 includes a handle member 26. A plate end 28 of the handle member 26 is fixedly coupled to the plate member 20 proximate a proximal end 30 of the plate member 20. The handle member 26 is designed for being selectively couplable to the user 16 and selectively retaining cooking utensils.

The handle member 26 has a hook portion 32. The hook portion 32 comprises a substantially curved section 34 such that the hook portion 32 is designed for hanging onto an apron string 36 or the like of a user 16 for the purpose of supporting the flat elongate member12 on the user 16's body.

The handle member 26 has a retainer portion 38. The retainer portion 38 comprises a substantially arced section 40. The retainer portion 38 is bent at an angle opposite the hook portion 32 such that the retainer portion 38 forms a utensil portion 42. The utensil portion 42 of the retainer portion 38 has a flattened cross section 44 such that the utensil portion 42 of the retainer portion 38 is designed for allowing a square section of the pair of cooking tongs 18 to be placed evenly into the utensil portion 42.

The handle member 26 has a keeper section 46. The keeper section 46 is an extension of the retainer portion 38 such that the keeper section 46 is designed for retaining the cooking utensil in the retainer portion 38 while the user 16 is actively moving about.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cooking utensil retaining apparatus for carrying cooking utensils while working, the cooking utensil retaining apparatus comprising:

a flat elongate member, said flat elongate member having a plurality of bends, said plurality of bends being adapted for forming said flat elongate member in such a manner that said flat elongate member is releasably attachable to a user for the purpose of carrying cooking utensils such as a pair of cooking tongs while working; and said flat elongate member having a planar plate member and a handle member extending from said planar plate member, said plate member being generally triangular, said handle member extending from an apex of said generally triangular plate member whereby said plate member is adapted for being positioned between a user's body and a belt extending around the user's body such that the belt is positioned below a hook portion of said handle member and adjacent said apex of said plate member, said plate member further being positioned such that side edges of said plate member extend outwardly below the belt such that the belt wraps around a top portion of said plate member whereby said side edges of said plate member inhibit removal of said plate member from between the user's body and the belt while the belt is in a curved position wrapping around the user's body.

2. The cooking utensil retaining apparatus as set forth in claim 1, further comprising:

said plate member having substantially rounded corners.

3. The cooking utensil retaining apparatus as set forth in claim 1, further comprising:

said hook portion being substantially arcuate such that said handle member extends down and away from said plate member to form an acute angle.

4. The cooking utensil retaining apparatus as set forth in claim 1, further comprising:

a keeper section of said handle member having a distal end positioned at an elevation above said hook portion during use for facilitating retention of the cooking utensils by said handle member.

* * * * *